US005316283A

United States Patent [19]

Tyson et al.

[11] Patent Number: 5,316,283

[45] Date of Patent: May 31, 1994

[54] CLUTCH MECHANISM FOR A SHEET FEEDER

[75] Inventors: Ben B. Tyson, Eagle, Id.; Alfonso German, Zapopan, Mexico

[73] Assignee: Hewlett-Packard Company, Palo Alto, Calif.

[21] Appl. No.: 81,049

[22] Filed: Jun. 21, 1993

[51] Int. Cl.[5] ..... B65H 3/06

[52] U.S. Cl. ..... 271/114; 271/119

[58] Field of Search ..... 271/114, 115, 116, 119

[56] References Cited

U.S. PATENT DOCUMENTS 4,679,953 7/1987 Sone et al. ..... 271/119
4,682,769 7/1987 Murakami et al. ..... 271/119

FOREIGN PATENT DOCUMENTS 0193830 7/1990 Japan ..... 271/114
4106032 4/1992 Japan ..... 271/114

*Primary Examiner*—H. Grant Skaggs

[57] ABSTRACT

An improved sheet feeder mechanism includes a D-shaped roller that is mounted on a shaft and is positioned transversely to a direction of sheet feed. A D-roller gear is mounted on the shaft and has both a non-recessed geared region and a recessed non-geared region that extends partially about a circumference of the D-roller gear. A shaft extension extends from and is attached to the shaft, and a spring engages the shaft extension to cause the shaft and the D-roller gear to rotate to a position that enables a gear drive to engage the non-recessed geared region of the D-roller gear. A spiral cam assembly is mounted for rotation with the gear drive and includes a spiral cam that is positioned between and resiliently bears upon inner and outer annuli of the cam assembly. A control arm engages both the spiral cam and the shaft extension and is responsive to rotation in a first direction of the cam assembly to enable the spring to move the shaft extension and D-roller gear to a position where a non-recessed, geared region aligns with the gear drive. The control arm is further responsive to rotation in a second direction of the cam assembly, after the first direction rotation, to enable rotation of the D-roller gear by the gear drive so as to cause a sheet feed.

6 Claims, 3 Drawing Sheets

10
12
14
16
18
20
22
26
28
30
32
40
42
44
46
48
50
52
54
56
60
62
64
66
70

50
52
56
62
50
55

CLUTCH MECHANISM FOR A SHEET FEEDER

FIELD OF THE INVENTION

This invention relates to sheet feed mechanisms, and more particularly, to a single-revolution sheet feed mechanism employing a paper pick roller and a non-slip driving mechanism.

BACKGROUND OF THE INVENTION

While there are many existing designs for sheet feed mechanisms, one of the more popular designs employed in copiers, facsimiles, etc. is shown in FIG. 1. Sheets 10 to be individually fed, are positioned in a tray 12 and are held in position by separators 14. A D-shaped roller 16 is mounted for rotation on a shaft 18. A single clockwise rotation of D-shaped roller 16 will cause a single sheet 10 to be fed in the direction indicated by arrow 20. D-shaped roller is also called a paper-pick roller.

Shaft 18 is connected to a D-roller gear 22 that has a section 24 wherein the gear teeth have been removed (gear teeth are shown schematically). A mating drive gear 26 is mounted on a drive shaft 28 that is in turn connected to a bi-directional drive motor (not shown).

The portion of shaft 18 to the right of D-roller gear 22 has a radially extending shaft extension 30 which, in cooperation with leaf spring 32 and solenoid 34, enables shaft 18 to make a single revolution and accomplish the feeding of a single sheet. Leaf spring 32 bears against shaft extension 30 and biases it in a clockwise direction. An armature 36 is spring biased to engage control arm 30 and in that position, prevents clockwise rotation of shaft 18.

To enable the feeding of a sheet, solenoid 34 is actuated and withdraws armature 36 from engagement with shaft extension 30. This action frees shaft extension 30 to be acted upon by spring 32. Once shaft extension 30 has just passed armature 36, solenoid 34 is disengaged to enable armature 36 to re-engage shaft extension 30 at the end of a single rotation of D-roller shaft 18. A subsequent energization of the drive motor causes shaft 28 to rotate in a counterclockwise direction, thus enabling drive gear 26 to rotate D-roller gear 22 (and shaft 18) in a clockwise direction. The resulting rotation of D-roller 16 engages a sheet 10 and moves it in the direction shown by arrow 20. When recessed portion 24 of D-roller gear 22 reaches drive gear 26, drive gear 26 and D-roller gear 22 disengage. Armature 36 again engages shaft extension 30 at the end of a single rotation.

Others have attempted to reduce the cost of the sheet feed mechanism shown in FIG. 1 by eliminating solenoid 34 and mounting a slip clutch on shaft 18. The slip clutch is dependent upon controlled friction between the clutch mechanism and drive shaft 18, which friction, if too great, causes drive shaft 18 to bind and if too little, enables the clutch mechanism to slip on the shaft uncontrollably. The slip clutch design also employs fixed stops which tend to generate stick-slip noise and be subject to wear.

Accordingly, it is an object of this invention, to provide an improved sheet feed mechanism that avoids the need for solenoid-operated engagement of a control arm.

It is another object of this invention to provide an improved sheet feeder that avoids the use of a slip clutch to control the feeder's operation.

It is yet another object of this invention to provide an improved sheet feeder that is low in cost and reliable in operation.

SUMMARY OF THE INVENTION

An improved sheet feeder mechanism includes a D-shaped roller that is mounted on a shaft and is positioned transversely to a direction of shee feed. A D-roller gear is mounted on the shaft and has both a non-recessed geared region and a recessed non-geared region that extends partially about a circumference of the D-roller gear. A shaft extension protrudes from the shaft, and a spring engages the shaft extension to cause the shaft and the D-roller gear to rotate to a position that enables a gear drive to engage the non-recessed geared region of the D-roller gear. A spiral cam assembly is mounted for rotation with the gear drive and includes a spiral cam that is positioned between and resiliently bears upon inner and outer annuli of the cam assembly. A control arm engages both the spiral cam and the shaft extension and is responsive to rotation in a first direction of the cam assembly to enable the spring to move the shaft extension and D-roller gear to a position where a non-recessed, geared region aligns with the gear drive. The control arm is further responsive to rotation in a second direction of the cam assembly, after the first direction rotation, to enable rotation of the D-roller gear by the gear drive so as to cause a sheet feed.

DETAILED DESCRIPTION OF THE INVENTION

Figure 1:
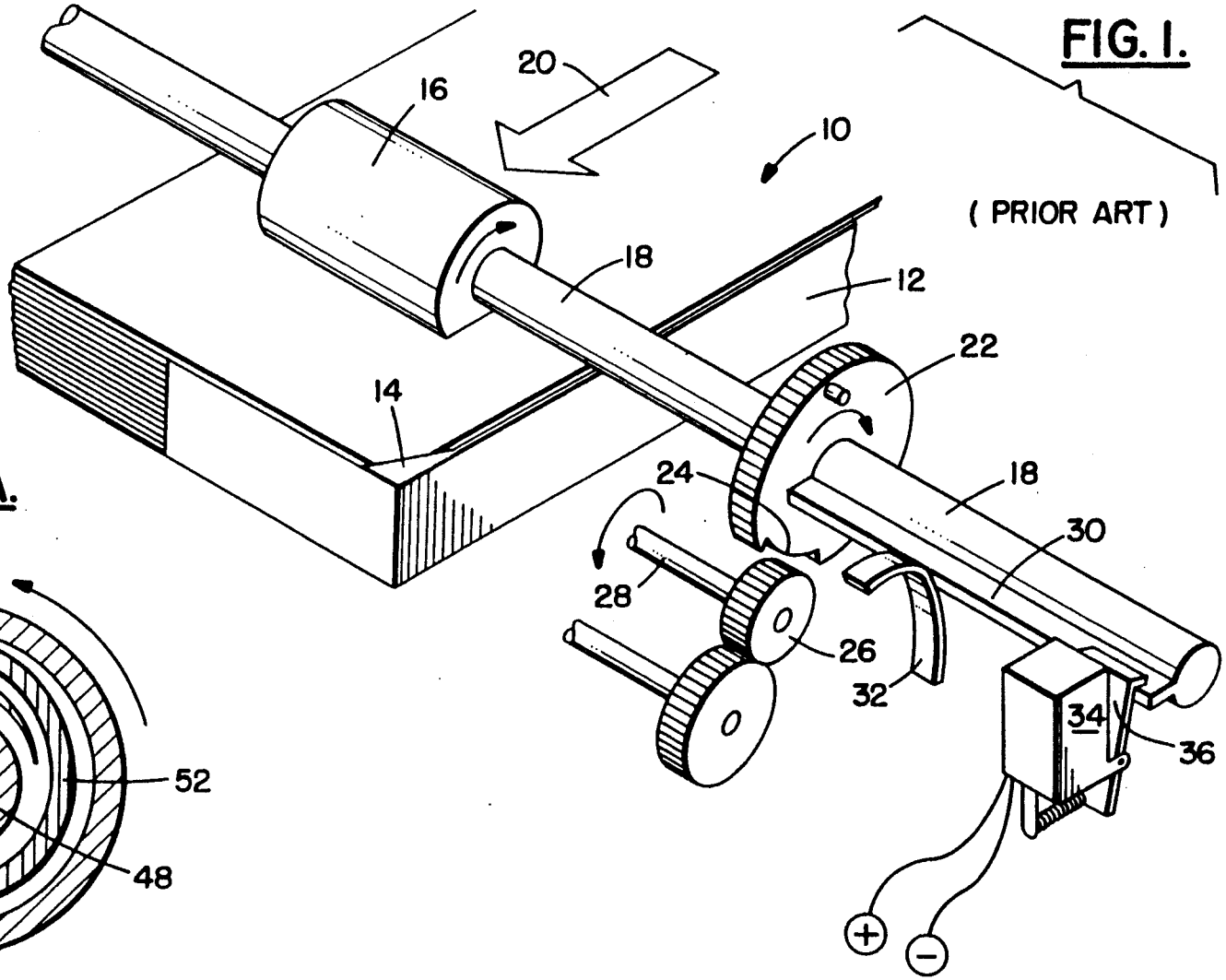
FIG. 1 is a perspective view of a prior art sheet feed mechanism.
Figure 2A:
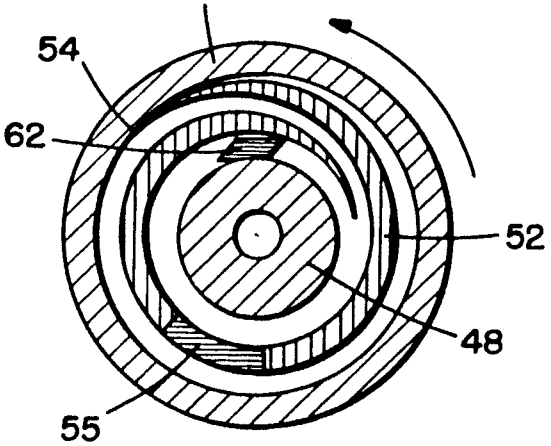
FIGS. 2A, 2B illustrate enlarged end views of the spiral cam mechanism used with the invention.
Figure 2:
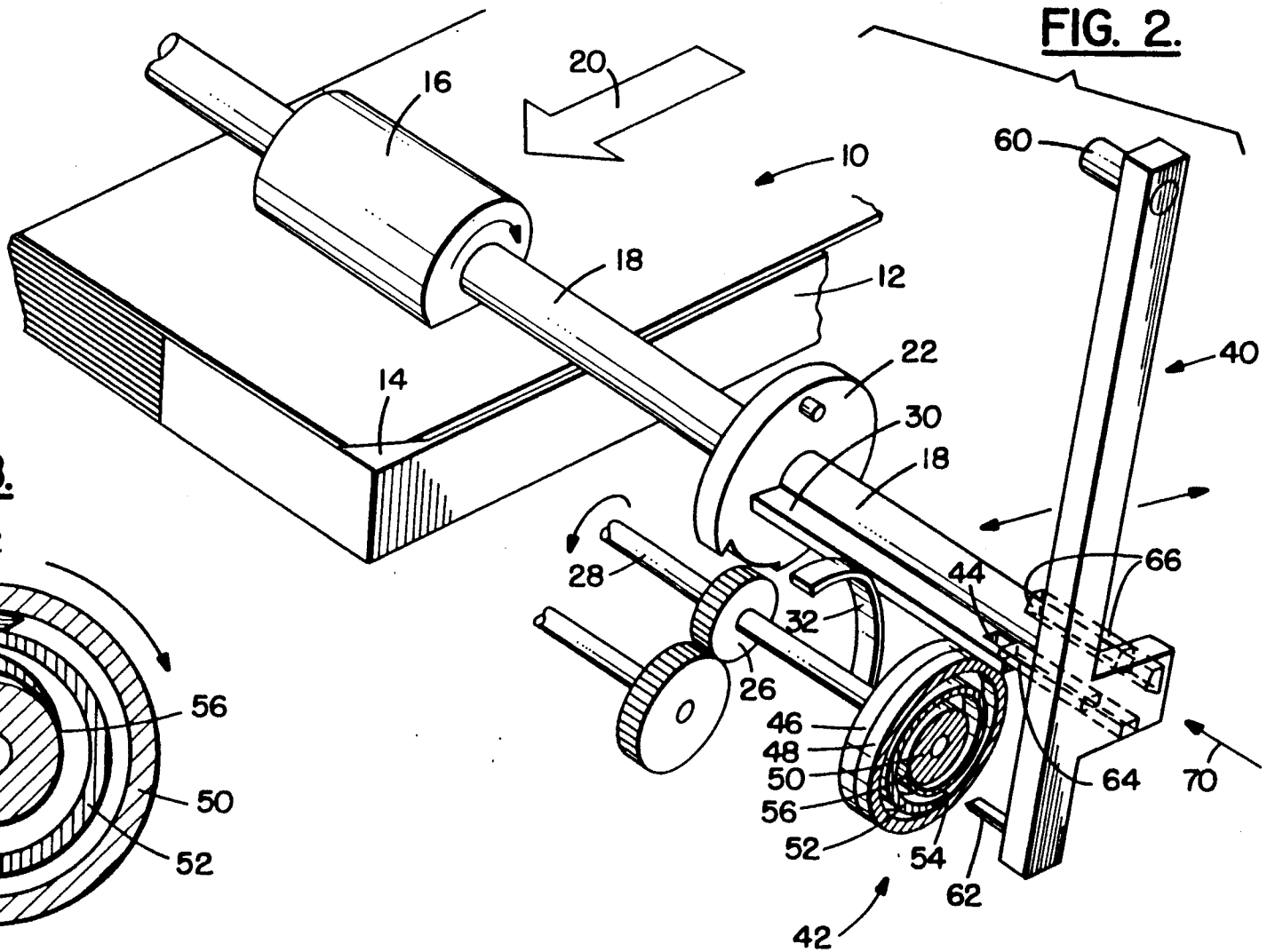
FIG. 2 is a perspective view of a sheet feed mechanism which incorporates the invention.

Referring to FIG. 2, elements that are common to the prior art structure shown in FIG. 1 are commonly numbered. A control arm 40 and spiral cam assembly 42 have been added to the mechanism. A slot 44 is provided in shaft extension 30 so as to enable selective engagement with control arm 40 during the operation of the sheet feed mechanism.

Figure 2B:
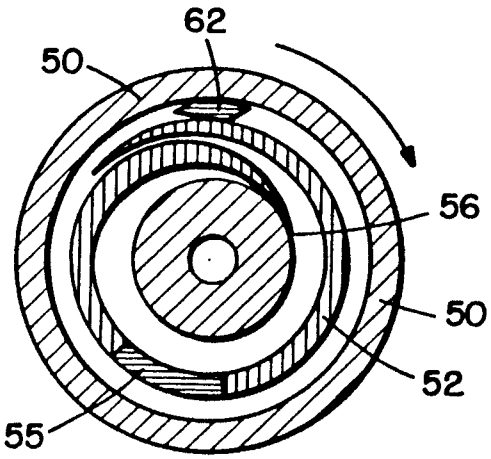

Spiral cam assembly 42 includes a circular back plate 46 from which projects an outer annulus 48 and an inner annulus 50. Enlarged end views of spiral cam assembly are shown in FIGS. 2B and 2C. A spiral cam 52 resiliently engages the inner surface of outer annulus 48 at point 54 and engages the outer surface of inner annulus 50 at point 56. At an intermediate point 55 (between points 54 and 56), resilient spiral cam 52 is joined to back plate 46. The resilience of spiral cam 52 is such that when a follower (e.g. 62) is present in a slot in cam assembly 42, clockwise rotation of cam assembly 42 (FIG. 2B) causes follower 62 eventually to force the resiliently bearing portion of spiral cam 52 away from the inner surface of outer annulus 48. Continued rotation in the clockwise direction merely causes follower 62 to remain in the outer track. Similarly, when spiral cam assembly 42 rotates in a counter-clockwise direction (FIG. 2A) and the follower reaches point of engagement 56, a similar forcing-away occurs between spiral cam 52 and inner annulus 50. Follower 62 remains in the innermost track so long as counter-clockwise rotation continues.

A control arm 40 is shown slightly removed from spiral cam assembly 42 to enable a better visualization of its functions. Control arm 40 is rotatably mounted on shaft 60 and includes a follower 62 at its lowermost end that is sized to fit within a slot in spiral cam assembly 42. A pair of stops 64 and 66 extend transversely from control arm 40 and act to limit movement of shaft extension 30 during operation of the sheet feed mechanism.

Referring now to FIGS. 3A-3C and 4A-4C, the operation of the sheet feed mechanism of FIG. 2 will be explained. It is to be understood that the views shown in FIGS. 3A-3C and 4A-4C are taken from the perspective indicated by arrow 70 (shown to the right of FIG. 2). Control arm 40 is shown transparently so as to enable an understanding of the operation of spiral cam assembly 42. Each of the elements shown in FIG. 3A-3C and 4A-4C are numbered in accordance with the numbering found in FIG. 2. Cross-hatched area 55 indicates where spiral cam 52 is attached to back plate 46. Otherwise, the arms of spiral cam 52 are resilient and bear upon annuli 48 and 50, as aforesaid.

Figure 3A:
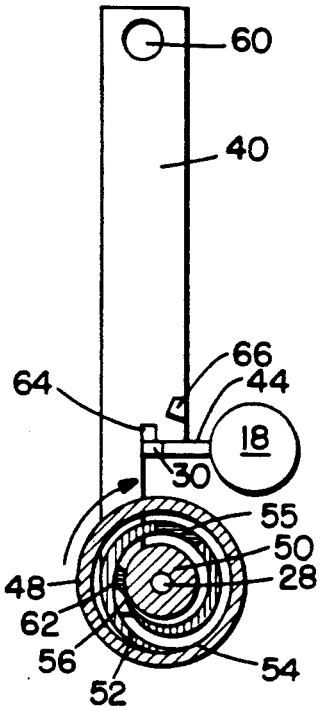
FIGS. 3A–3C schematically illustrate the operation of a control arm in the sheet feed mechanism of FIG. 2 during clockwise rotation of a spiral cam.
Figure 3B:
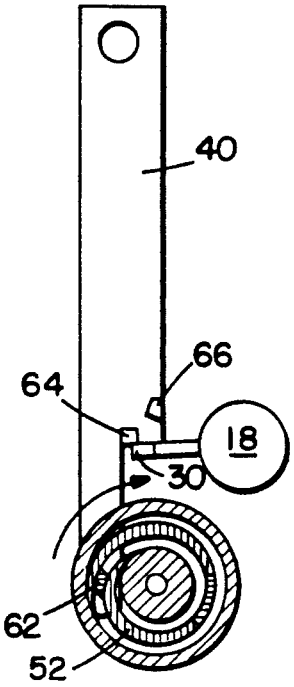

FIG. 3A illustrates the start of a feed cycle wherein the motor attached to shaft 28 begins to rotate in a clockwise direction. The resulting rotation of spiral cam 52 causes follower 62 to track outwardly in the spiral cam track and to move control arm 40 in a leftward direction. Shaft extension 30 (attached to shaft 18) is held in place by stop 64 on control arm 40. As shaft 28 turns further clockwise (see FIG. 3B), follower 62 moves further along the spiral cam track, but shaft extension 30 is still restrained from rotation by stop 64.

Continued clockwise rotation of spiral cam assembly 42 causes follower 62 to reach a leftmost limit of travel in the spiral cam track. Shaft extension 30 thereby disengages from stop 64, is moved clockwise by spring 32 but is caught by stop 66. The result of this action is to align D-roller gear 22 for subsequent engagement with drive gear 26. The purpose of second stop 66 is the following: If D-roller shaft 18 were released during the clockwise cycle (FIG. 3C), the first tooth of D-roller gear 22 would be forced into contact with drive gear 26. However, since the motion of drive gear 26 would still be "reverse" (clockwise), the teeth on drive gear 26 would chatter on the first tooth of D-roller gear 22. The second stop 66 delays the release of D-roller shaft 18 until the forward (counterclockwise) motion is underway. In the forward direction, the first tooth of D-roller gear 22 is immediately driven by drive gear 26, so there is no gear chatter.

To the extent that spiral cam assembly 42 continues clockwise rotation, follower 62 forces spiral cam 52 away from outer annulus 48. When follower 62 passes point 54, the end of spiral cam 52 snaps back to its rest position. Since the spiral cam track is continuous, with no end stops, there is no risk of high loads which could damage gear train components.

Figure 4A:
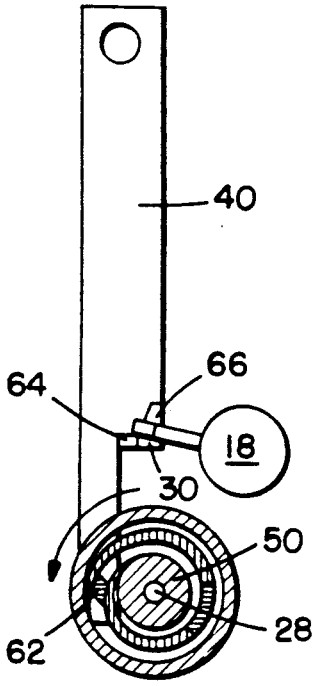
FIGS. 4A–4C schematically illustrate the operation of the control arm during counter-clockwise rotation of the spiral cam mechanism.
Figure 4B:
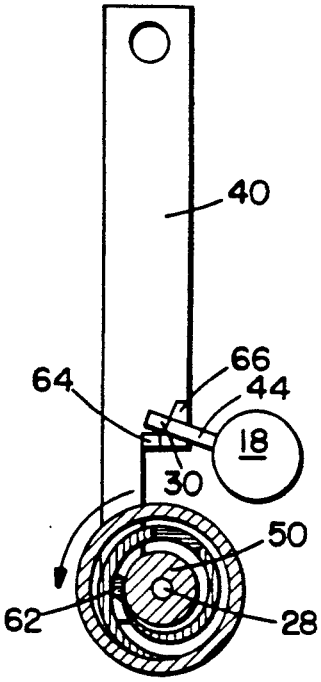
Figure 4C:
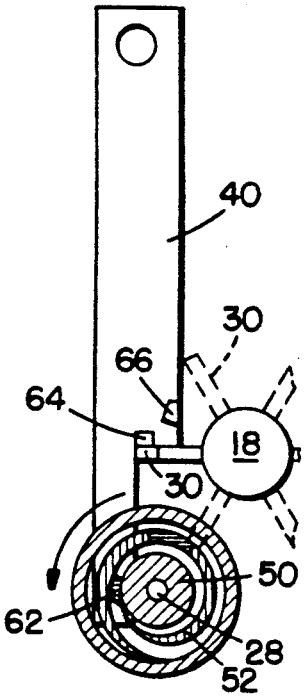

At this time, the rotation of shaft 28 is changed to a counterclockwise direction and follower 62 commences movement towards inner annulus 50 as a result of the rotation of spiral cam assembly 42 (see FIG. 4A). Continued counterclockwise rotation of shaft 28 (FIG. 4B) causes follower 62 to reach the innermost spiral cam track and inner annulus 50. The resulting rightward movement of control arm 40 causes cutaway section 44 of shaft extension 30 to become aligned with stop 66 and frees shaft 18 for rotation. This action enables spring 32 (FIG. 2) to further move shaft 18 in a clockwise direction until the first tooth of D-roller gear 22 engages drive gear 26. At this point, the counterclockwise movement of shaft 18 (see FIG. 4C) rotates D-roller gear 22 and enables D-roller 16 to pick the top sheet from a stack held in tray 12. After shaft 18 makes one complete revolution, shaft extension 30 again engages stop 64 and the feed cycle is complete.

Figure 3C:
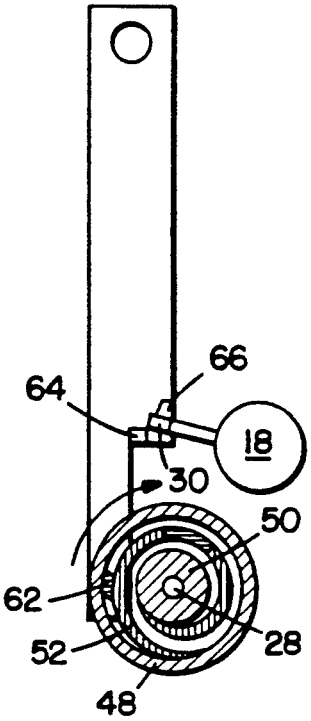

As described with respect to FIG. 3C, should spiral cam assembly 42 over-rotate in the counterclockwise direction, follower 62 merely causes the flexible portion of spiral cam member 52 to be forced away from inner annulus 50, thereby creating a ratchet action.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet feeder mechanism comprising:

a D-shaped roller mounted on a shaft, said shaft positioned transversely to a direction of sheet feed;

a D-roller gear mounted on said shaft and having a geared region and recessed region that extends partially about a circumference of said D-roller gear;

gear drive means for engaging said geared region of said D-roller gear and causing rotation of said D-roller gear, said shaft and said D-roller;

a shaft extension extending from said shaft;

spring means engaging said shaft extension for causing said shaft extension, shaft and D-roller gear to rotate to a position that enables said gear drive means to engage said geared portion of said D-roller gear;

cam means mounted for rotation with said gear drive means, said cam means including a rotatable spiral cam positioned between and resiliently bearing upon, inner and outer annuli; and control arm means engaged by said cam means and said shaft extension, and responsive to rotation in a first direction of said cam means, to enable said spring means to move, via said shaft extension and shaft, said geared portion of said D-roller gear to an alignment position with said gear drive means, and further responsive to rotation of said cam means in a second direction, after said first direction rotation, to cause said gear drive means to rotate said D-roller gear, shaft and D-roller to thereby cause a sheet feed.

2. The sheet feeder as recited in claim 1, wherein said control arm means includes a follower, which, upon rotation in said first direction of said cam means by more than a predetermined amount, is caused to pass between a point of resilient engagement between the spiral cam and outer annulus, and upon rotation in a said second direction of said cam means by more than a predetermined amount, is caused to pass between a point of resilient engagement between said spiral cam and said inner annulus.

3. The sheet feeder as recited in claim 2, wherein said control arm means further comprises an arm mounted for rotation, and wherein said follower is oriented transversely to said control arm means to engage said cam means.

4. The sheet feeder as recited in claim 3, wherein said arm of said control arm means further includes a first stop that initially engages said shaft extension, rotation of said cam means in said first direction causing said arm to bring said first stop out of engagement with said shaft extension and allowing said shaft extension to be moved by said spring means.

5. The sheet feeder as recited in claim 4, wherein said arm of said control arm means includes a second stop, said second stop positioned, when said cam means is rotated in said first direction so as to cause said arm to bring said first stop out of engagement with said shaft extension, said second stop intercepting said shaft extension during movement thereof by said spring means and positioning said geared region of said D-roller gear for engagement by said gear drive means.

6. The sheet feeder as recited in claim 5, wherein movement of said arm of said control arm means by rotation of said cam means in said second direction, after rotation of said cam means in said first direction, causes said second stop to be brought out of engagement with said shaft extension and enables rotation of said shaft extension, shaft, D-roller gear and D-roller by said gear drive means to enable a sheet feed to occur.

* * * * *